US007448474B2

(12) United States Patent
Aulanko et al.

(10) Patent No.: US 7,448,474 B2
(45) Date of Patent: Nov. 11, 2008

(54) METHOD FOR MAKING AN ELEVATOR AND SYSTEM FOR ELEVATOR DELIVERY

(75) Inventors: Esko Aulanko, Kerava (FI); Jorma Mustalahti, Hyvinkää (FI); Petteri Valjus, Helsinki (FI)

(73) Assignee: Kone Corporation, Helsinki (FI)

( * ) Notice: Subject to any disclaimer, the term of this patent is extended or adjusted under 35 U.S.C. 154(b) by 85 days.

(21) Appl. No.: 10/965,821

(22) Filed: Oct. 18, 2004

(65) Prior Publication Data

US 2005/0087398 A1 Apr. 28, 2005

Related U.S. Application Data

(63) Continuation of application No. PCT/FI03/00394, filed on May 23, 2003.

(30) Foreign Application Priority Data

May 28, 2002 (FI) ..... 20020996

(51) Int. Cl.
*B66B 7/08* (2006.01)

(52) U.S. Cl. ..... 187/411; 187/250; 187/254

(58) Field of Classification Search ..... 187/404, 187/266, 254, 411
See application file for complete search history.

(56) References Cited

U.S. PATENT DOCUMENTS

| | | | | | |
|---|---|---|---|---|---|
| 4,013,142 | A | * | 3/1977 | Hagg | 187/254 |
| 4,842,101 | A | * | 6/1989 | Lamb | 187/266 |
| 5,957,242 | A | * | 9/1999 | Suter et al. | 187/266 |
| 6,035,974 | A | * | 3/2000 | Richter et al. | 187/404 |
| 2005/0006180 | A1 | | 1/2005 | Mustalahti | |

FOREIGN PATENT DOCUMENTS

| | | | | |
|---|---|---|---|---|
| EP | 0 578 237 | A1 | | 1/1994 |
| EP | 0578237 | A1 | * | 1/1994 |
| EP | 1 327 598 | A1 | | 7/2003 |
| EP | 1327598 | A1 | * | 7/2003 |
| FI | 20020043 | | | 7/2003 |
| FR | 2 640 604 | | | 6/1990 |
| GB | 954319 | | | 4/1964 |
| WO | WO 99/43595 | | | 9/1999 |
| WO | WO9943595 | | * | 9/1999 |

* cited by examiner

*Primary Examiner*—Patrick Mackey
*Assistant Examiner*—Terrell H Matthews
(74) *Attorney, Agent, or Firm*—Harness, Dickey & Pierce, P.L.C.

(57) ABSTRACT

Method for making an elevator, wherein the roping is selected according to the weight of the elevator car using the same drive machine, traction sheave and rope sheave regardless of the roping. For heavy elevators, Single Wrap roping is used, wherein the hoisting ropes are passed around the traction sheave and the rope sheave guides the ropes and dampens their vibrations, while for light elevators Double Wrap roping is used.

14 Claims, 5 Drawing Sheets

METHOD FOR MAKING AN ELEVATOR AND SYSTEM FOR ELEVATOR DELIVERY

Figure 1:
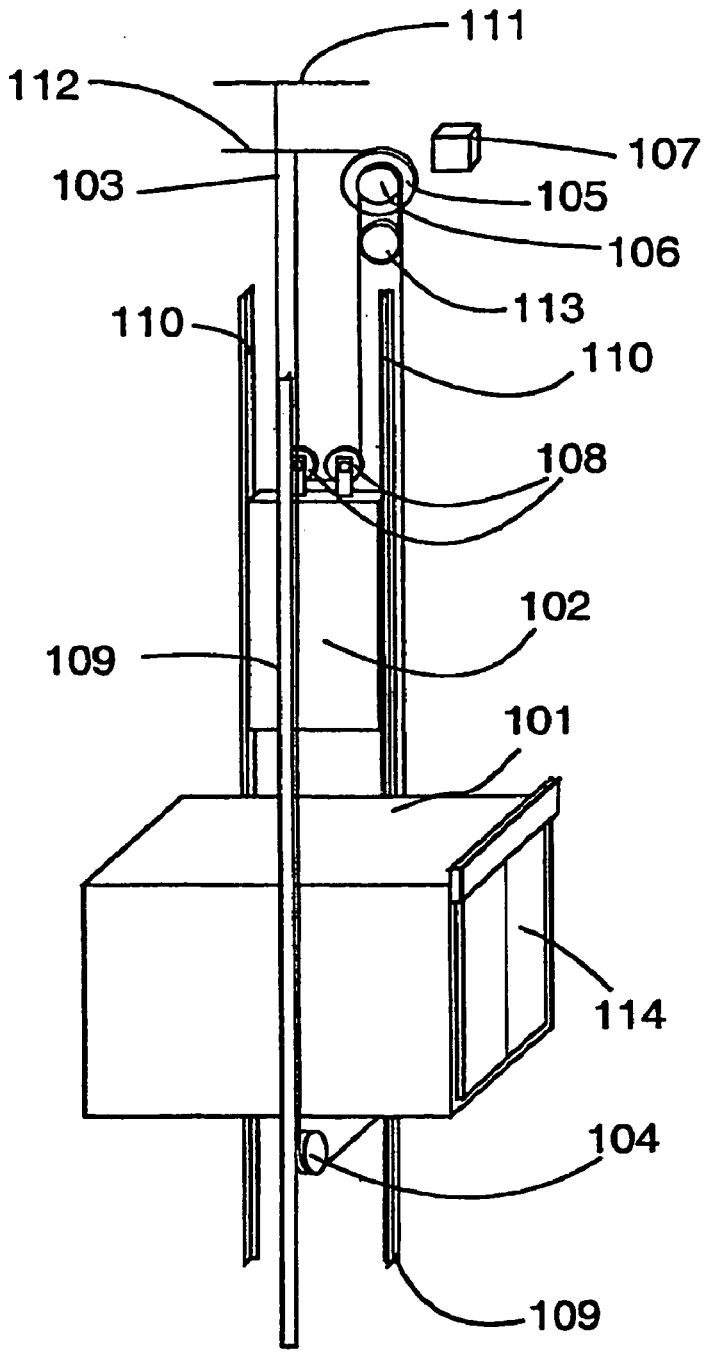

This application is a continuation of, and claims priority under 35 U.S.C. §120 and 35 U.S.C. §365(c) from, PCT International Application No. PCT/FI03/00394 which has an International filing date of May 23, 2003, which designated the United States of America and which claims priority on FINLAND Application Priority Number 20020996 filed May 28, 2002, the entire contents of which are hereby incorporated herein by reference.

Example embodiments relate to a method and a system for making an elevator.

BACKGROUND

The capability of the traction sheave of an elevator to transmit motion to the elevator hoisting ropes, as well as its capability to brake the rope, in other words, the grip between the traction sheave and the hoisting ropes, is substantially dependent on the length of the arc of contact between the hoisting ropes and the traction sheave and on the force with which the hoisting ropes are pressed against the traction sheave. In prior art, traction sheave elevator solutions are known in which the arc length used has been increased, e.g. by using a so-called Double Wrap roping arrangement or using an elevator car and counterweight of a relatively large weight in combination with the very common Single Wrap roping arrangement. In general, Double Wrap roping is used if it unreasonable to increase the weight of the hoisting cage and counterweight. For example, in fast elevators for a large hoisting height, it is more reasonable to improve the grip instead of increasing the moving masses. This type of fast elevators for a large hoisting height often also have compensating ropes or equivalent, which increase the weight of the moving masses while compensating the imbalance caused by the weight of the rope portions going to the elevator car and to the counterweight. In slower elevators designed for a lower hoisting height, a simple way of increasing the grip is to increase the weight of the car and counterweight. As a practical consequence of this, the starting points in the design of different elevators are very different and the final product ranges are at least to some degree non-uniform. Especially in slower elevators, relatively heavy elevator cars are needed even for small nominal loads.

SUMMARY

One of the object of the invention is to reduce the diversity of components in the process of delivery of different elevators. Example embodiments disclose a method wherein Single Wrap or Double Wrap roping is selected depending on whether the elevator car is heavy or light, and a delivery system wherein Single Wrap or Double Wrap roping is selected depending on whether the elevator car is heavy or light.

The grip between the ropes and the traction sheave is improved by increasing the rope angle. Double Wrap roping increases the rope angle by using a secondary sheave, providing an angle of contact between the traction sheave and the ropes that is typically 180 degrees larger than in a conventional Single Wrap solution with a rope angle of 180 degrees. In both Single Wrap and Double Wrap roping solutions, the rope angle may sometimes differ considerably from these values (180, 360 degrees), but for the invention an important consideration is the use of a good grip achieved by Double Wrap roping to enable a light-weight elevator and, in cases where a sufficient grip is achieved otherwise due to a heavy elevator, to allow elevators to be made using a substantially identical configuration.

In the Double Wrap roping arrangement, the hoisting ropes are passed twice around the traction sheave. In Double Wrap roping, the number of rope grooves on the traction sheave must naturally be twice the number of ropes used. On the other hand, a light-weight elevator does not require so many ropes to support the elevator car as a heavy elevator does. In a Single Wrap roping arrangement, a rope sheave, preferably of equal size with the traction sheave, functions as a so-called "tangential contact wheel", guiding the ropes and dampening their vibrations.

In Single Wrap roping, the rope sheave functions as a tangential contact wheel for the ropes going downward towards the car and counterweight and at the same time as a rope dampening wheel smoothing out rope vibrations. The ropes are passed once around the traction sheave and they only touch the rope sheave tangentially. In Double Wrap roping, the ropes are passed two and/or more times around the traction sheave at least once around the rope sheave. In Double Wrap roping, too, the rope sheave also functions as a rope dampening wheel.

By increasing the angle of contact, the rope sheave can be used to increase the grip between the traction sheave and the hoisting ropes. In this manner, the weight and size of the car and counterweight can be reduced, thus increasing the space saving potential of the elevator. Alternatively or at the same time, it is possible to reduce the weight of the elevator car in relation to the weight of the counterweight. An angle of contact of over 180° between the traction sheave and the hoisting rope is achieved by utilizing a rope sheave or rope sheaves.

For example, when a public building needs to be provided with several elevators, some of which are for personal use and some for service use, it is very practical and economical, by simply changing the roping, to provide all the elevators with identical traction or rope sheaves and identical machines. A modular construction and the circumstance that the decision regarding the implementation of the roping of the elevator can be made at the site of installation is logistically very economical. In the case of modernization, too, it is economical e.g. to replace a plastic carpet with a stone floor, thus making the elevator car considerably heavier, and consequently it is only necessary to change the roping between the traction sheave and the rope sheave and increase the load-bearing capacity of the hoisting ropes by increasing the number of ropes.

An example embodiment of the elevator of the invention is an elevator without machine room and without above, in which the drive machine is provided with a coated traction sheave. The angle of contact between the hoisting ropes and the traction sheave of the elevator is greater than 180°. The elevator comprises a unit containing a mounting base with the drive machine, the traction sheave and a rope sheave fitted on it.

By using the invention, the following advantages can be achieved, among others:

- the grip between the ropes and the traction sheave is improved as the rope angle is increased,
- the same machine covers a wide car weight range
- in consequence of improved grip, the car and counterweight can be made lighter and smaller
- the weight of the elevator car in relation to the weight of the counterweight can be reduced,
- as the number of rope grooves needed in Double Wrap roping is twice the number of ropes, the number of rope grooves on the sheave is sufficient even for Single Wrap roping in the case of heavy cars

- uniformity of components allows considerable cost savings to be achieved
- the invention reduces the elevator installation time and total installation costs
- the elevator is economical to manufacture and install because the uniformity of traction sheave, machine and rope sheave reduces the number of different components,
- although the invention is primarily intended for use in elevators without machine room, it can be applied for use in elevators with machine room as well
- the invention can be applied in gearless and geared elevator motor solutions,
- the use of the same machine, traction sheave and rope sheave means considerable cost savings.

An area of application of the invention is elevators designed for the transportation of people or freight. Another area of application of the invention is passenger elevators whose speed range is conventionally about 1.0 m/s or higher but may also e.g. only about 0.5 m/s. In the case of freight elevators, too, the speed is preferably at least about 0.5 m/s, although with greater loads even lower speeds may be used.

DETAILED DESCRIPTION OF THE DRAWINGS

Figure 2:
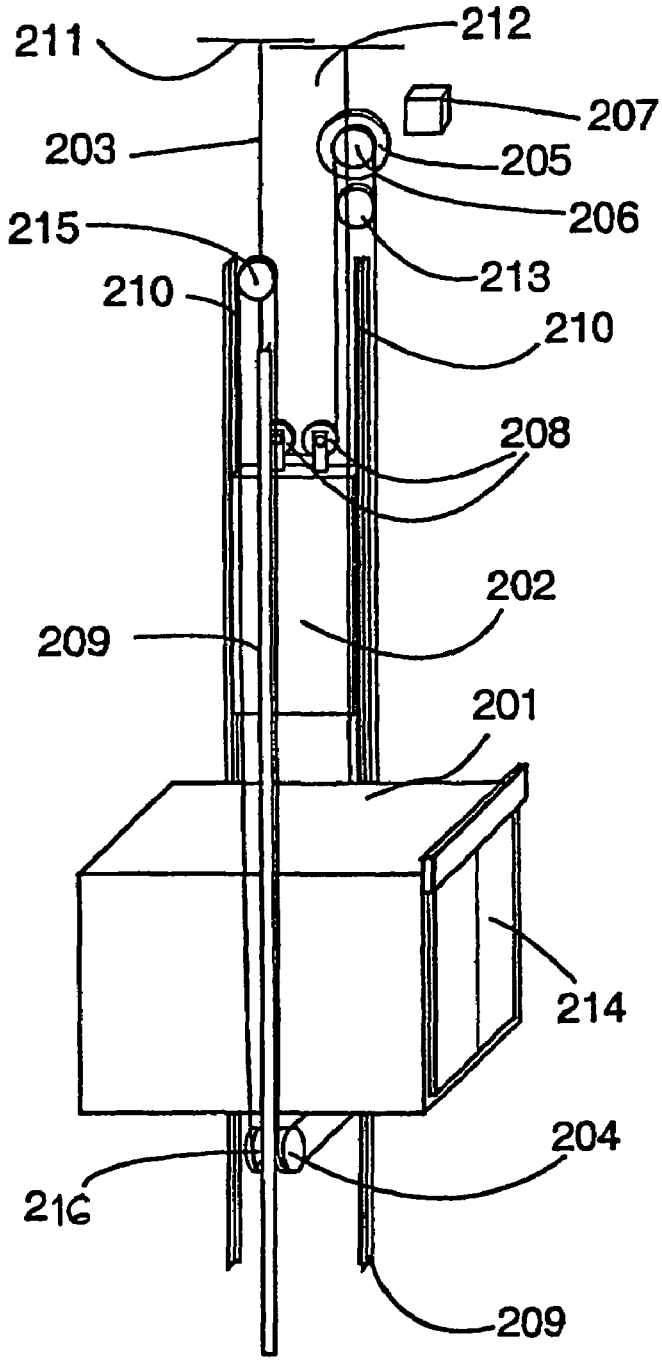
Figure 3:
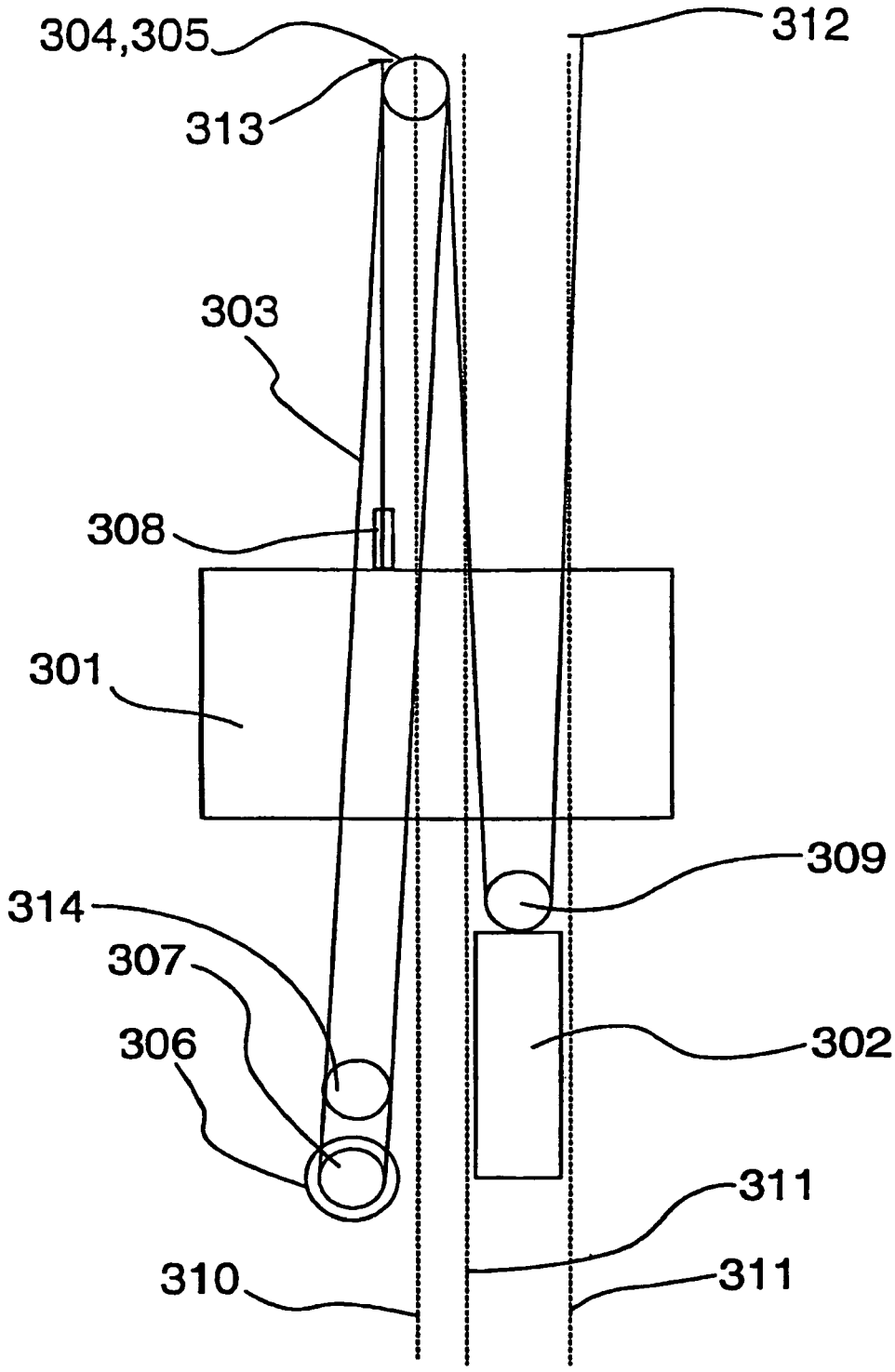
Figure 4:
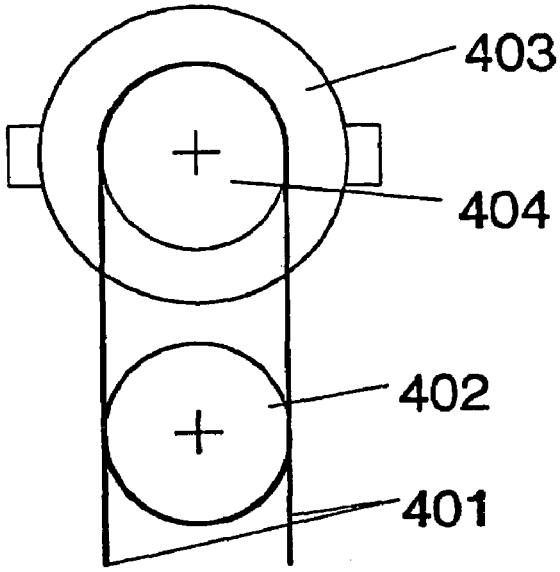
Figure 5:
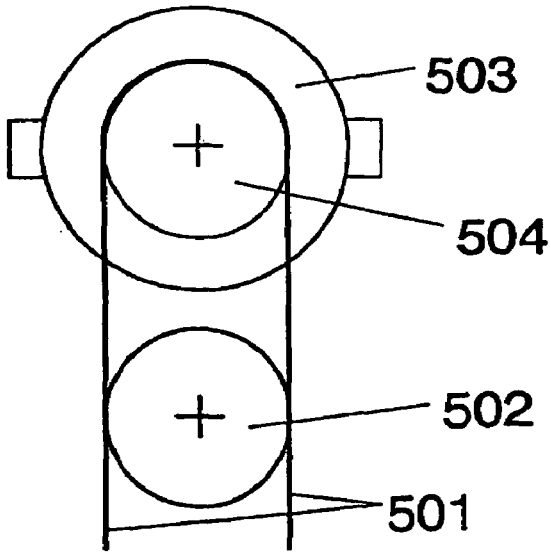
Figure 6:
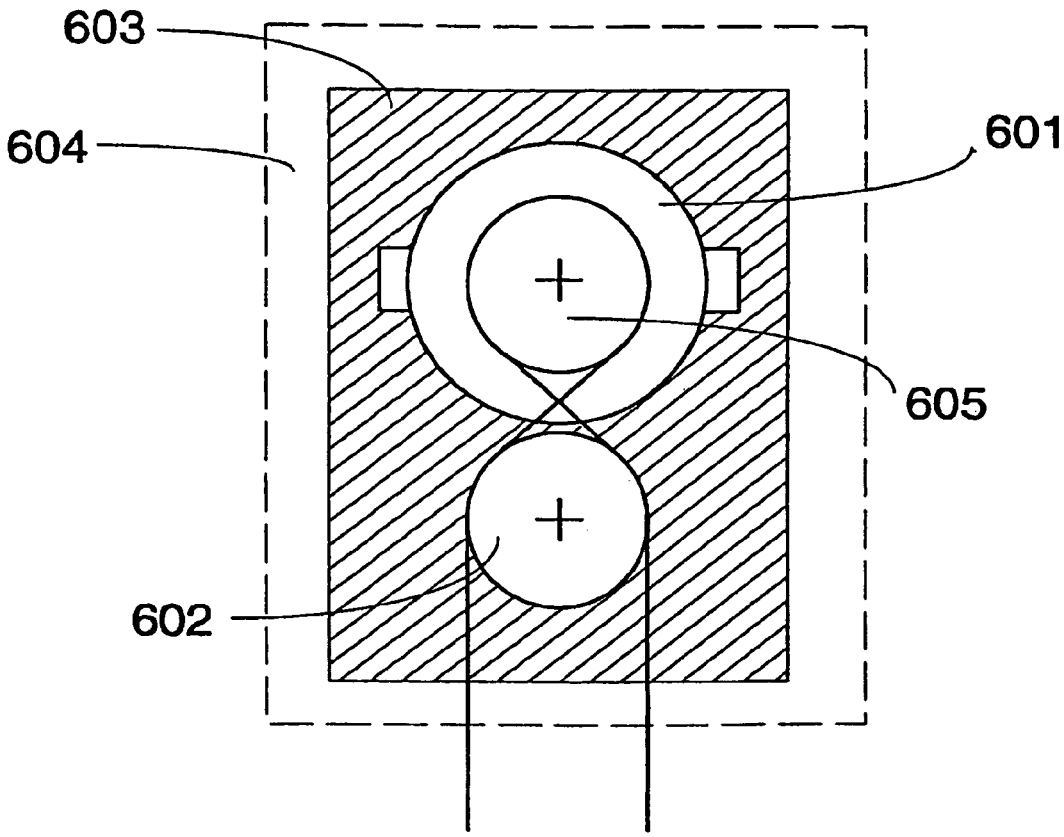

In the following, the invention will be described in detail by the aid of a few examples of its embodiments with reference to the attached drawings, wherein FIG. 1 presents a diagram representing an elevator implemented by the method of the invention, FIG. 2 presents a diagram representing another elevator implemented by the method of the invention, FIG. 3 presents a diagram representing a third elevator implemented by the method of the invention, FIG. 4 presents a traction sheave roping arrangement according to the invention, FIG. 5 presents another traction sheave roping arrangement according to the invention, FIG. 6 presents an embodiment of the invention.

DESCRIPTION OF EXAMPLE EMBODIMENTS

FIG. 1 is a diagrammatic representation of the structure of an elevator. The elevator is preferably an elevator without machine room, with the drive machine 105 placed in the elevator shaft. The elevator presented in FIG. 1 is a traction sheave elevator with machine above. The passage of the hoisting ropes 103 of the elevator is as follows. One end of the hoisting ropes 103 is immovably fixed to an anchorage 111 located in the upper part of the shaft above the path of a counterweight 102 moving along counterweight guide rails 110. From the anchorage 111, the hoisting ropes 103 run downward and are passed around rope sheaves 108 suspending the counterweight 102 and rotatably mounted on it, from which rope sheaves 108 the hoisting ropes 103 run further upward to the traction sheave 106 of the drive machine 105, passing around the traction sheave 106 along the rope grooves of the traction sheave 106. From the traction sheave 106, the hoisting ropes 103 run further downward back to a rope sheave 113, passing around it along the rope grooves of the rope sheave 113, after which they return back up to the traction sheave 106 and pass around it along the rope grooves of the traction sheave 106. From the traction sheave 106, the hoisting ropes 103 go again downwards via the rope grooves of the rope sheave 113 to the elevator car 101 moving along the car guide rails 109 of the elevator, passing under the elevator car 101 via rope sheaves 104 used to suspend the elevator car 101 on the hoisting ropes 103, and going then upwards again from the elevator car 101 to an anchorage 112 in the upper part of the elevator shaft, where the second end of the hoisting ropes 103 is immovably fixed. The roping arrangement between the traction sheave 106 and the rope sheave 113 is referred to as Double Wrap ("DW") roping, wherein the hoisting ropes 103 are wrapped around the traction sheave 106 two and/or more times. In this way, the angle of contact can be increased in two and/or more stages. For example, in the embodiment presented in FIG. 1, an angle of contact of 180°+180°, i.e. 360°, between the traction sheave 106 and the hoisting ropes 103 is achieved. FIG. 1 represents the economical 2:1 suspension ratio. Other suspension solutions are possible in an embodiment according to the invention. The suspension of the counterweight 102 and elevator car 101 may also be such that the counterweight 102 is suspended with a suspension ratio of n:1 while the elevator car 101 is suspended with a suspension ratio of m:1, where m is an integer at least equal to 1 and n is an integer greater than m. The elevator presented in FIG. 1 has automatic telescoping doors 114, but within the framework of the invention it is also possible to use other types of automatic doors or turning doors.

The drive machine 105 placed in the elevator shaft is preferably of flat construction, in other words, the machine has a small thickness dimension as compared with its width and/or height, or at least the machine is slim enough to be accommodated between the elevator car and a wall of the elevator shaft. The machine may also be placed differently, e.g. by disposing the slim machine partly or completely between an imaginary extension of the elevator car and a shaft wall. The elevator shaft is advantageously provided with equipment required for the supply of power to the motor driving the traction sheave 106 as well as equipment needed for elevator control, both of which can be placed in a common instrument panel 107 or mounted separately from each other or integrated partly or wholly with the drive machine 105. The drive machine may be of geared or gearless type.

FIG. 2 presents a diagram representing another elevator structure. The elevator is preferably an elevator without machine room, with the drive machine 205 placed in the elevator shaft. The elevator shown in FIG. 2 is a traction sheave elevator with machine above. The passage of the hoisting ropes 203 of the elevator is as follows. One end of the hoisting ropes 203 is immovably fixed to an anchorage 211 located in the upper part of the shaft above the path of a counterweight 202 moving along counterweight guide rails 210. From the anchorage 211, the hoisting ropes 203 run downward and are passed around rope sheaves 208 suspending the counterweight 202 and rotatably mounted on it, from which rope sheaves 208 the hoisting ropes 203 run further upward via the rope grooves of rope sheave 213 to the traction sheave 206 of the drive machine 205, passing around the traction sheave 206 along the rope grooves of the traction sheave 206. From the traction sheave 206, the hoisting ropes 203 run further downward back to the rope sheave 213, passing around it along the rope grooves of the rope sheave 213, after which they return back up to the traction sheave 206 and pass around it along the rope grooves of the traction sheave 206. From the traction sheave 206, the hoisting ropes 203 run further downward via the rope grooves of the rope sheave 213 to the elevator car 201 moving along the car guide rails 209 of the elevator, passing under the elevator car 201 via rope sheaves 204 used to suspend the elevator car 201 on the hoisting ropes 203, over rope sheave 215, again passing under the elevator car 201 via rope sheaves 216, and then going upwards again from the elevator car 201 to an anchorage 212 in the upper part of the elevator shaft, where the second end of the hoisting ropes 203 is immovably fixed. In FIG. 2, an elevator according to the invention with a suspension ratio of 4:1 is presented. The invention can also be implemented using other suspension solutions. The elevator presented in FIG. 2 has automatic telescoping doors 214, but within the framework of the invention it is also possible to use other types of automatic doors or turning doors.

The drive machine 205 placed in the elevator shaft is preferably of flat construction, in other words, the machine has a small thickness dimension as compared with its width and/or height, or at least the machine is slim enough to be accommodated between the elevator car and a wall of the elevator shaft. The machine may also be placed differently, e.g. by disposing the slim machine partly or completely between an imaginary extension of the elevator car and a shaft wall. The elevator shaft is advantageously provided with equipment required for the supply of power to the motor driving the traction sheave 206, both of which can be placed in a common instrument panel 207 or mounted separately from each other or integrated partly or wholly with the drive machine 205. The drive machine may be of geared or gearless type.

FIG. 3 presents a diagram of a roping arrangement according to the invention. In this elevator, the ropes go upwards from the machine. An elevator like this is in most cases a traction sheave elevator with machine below. The elevator car 301 and counterweight 302 are suspended on the elevator hoisting ropes 303. The drive machine unit 306 of the elevator is placed in the elevator shaft, preferably in the lower part of the elevator shaft. Mounted in a position near the drive machine unit 306 is a rope sheave 314, means makes it possible to achieve a sufficiently large angle of contact between the traction sheave 307 and the hoisting ropes 303. The hoisting ropes are passed over rope sheaves 304,305 placed in the upper part of the shaft to the car 301 and to the counterweight 302. The rope sheaves 304,305 in the upper part of the shaft are preferably separately mounted with bearings on the same axle to allow them to rotate independently of each other. The elevator in FIG. 3 is also an example of the application of Double Wrap roping in an elevator with machine below. The elevator car 301 and the counterweight 302 move in the elevator shaft along car and counterweight guide rails 310, 311 guiding them.

The hoisting ropes run as follows: One end of the ropes is fixed to an anchorage 312 in the upper part of the shaft, from where they go downward to the counterweight 302. The counterweight is suspended on the ropes 303 via a rope sheave 309. From the counterweight, the ropes go further upward to a first rope sheave 305 mounted on an elevator guide rail 310, and from the rope sheave 305 further via the rope grooves of rope sheave 314 to the traction sheave 307 driven by the drive machine 306. From the traction sheave, the ropes go again upwards to rope sheave 314, and having wrapped around it they go back to the traction sheave 307. From the traction sheave 307, the ropes go again upwards via the rope grooves of rope sheave 314 to rope sheave 304, and having wrapped around this sheave they pass via rope sheaves 308 mounted on the top of the elevator car and then go further to an anchorage 313 in the upper part of the elevator shaft, where the other end of the hoisting ropes is fixed. The elevator car is suspended on the hoisting ropes 303 by means of rope sheaves 308. In the hoisting ropes 303, one or more of the rope portions between the rope sheaves or between the rope sheaves and the traction sheave or between the rope sheaves and the anchorages may deviate from an exact vertical direction, a circumstance that makes it easy to provide a sufficient distance between different rope portions or a sufficient distance between the hoisting ropes and the other elevator components. The traction sheave 307 and the hoisting machine 306 are preferably disposed somewhat aside of the path of movement of the elevator car 301 as well as that of the counterweight 302, so they can be easily placed almost at any height in the elevator shaft below the rope sheaves 304 and 305. If the machine is not placed directly above or below the counterweight or elevator car, this will allow a saving in shaft height. In this case, the minimum height of the elevator shaft is exclusively determined on the basis of the length of the paths of the counterweight and elevator car and the safety clearances needed above and below these. In addition, a smaller space at the top or bottom of the shaft will be sufficient due to the reduced rope sheave diameters as compared with earlier solutions, depending on how the rope sheaves are mounted on the elevator car and/or on the frame of the elevator car.

FIG. 4 presents a roping arrangement according to the invention. In the roping arrangement presented in FIG. 4, the hoisting ropes 401 run via the rope grooves of a rope sheave 402 to the traction sheave 404 of the drive machine 403, passing around it along the rope grooves of the traction sheave 404. From the traction sheave 404, the hoisting ropes 401 go further downwards back to the rope sheave 402, passing around it along the rope grooves of the rope sheave 402 and returning back up to the traction sheave 404, around which they pass along the rope grooves of the traction sheave 404. From the traction sheave 404, the hoisting ropes 401 go further downwards via the rope grooves of the rope sheave 402. The roping presented in is a DW roping arrangement, where the hoisting ropes 401 are passed around the traction sheave 404 two and/or more times. This allows the angle of contact to be increased in two and/or more stages. At the same time, the rope sheave 402 functions as a damper wheel, compensating rope vibrations.

FIG. 5 presents another roping arrangement according to the invention. In the roping arrangement presented in FIG. 5, the ropes 501 run via the rope grooves of a rope sheave 502 to the traction sheave 504 of the drive machine 503, passing around it along the rope grooves of the traction sheave. From the traction sheave 504, the ropes 501 go again downwards, running via the grooves of the rope sheave 502. The roping arrangement presented in the figure is a Single Wrap roping arrangement, where the rope sheave functions as tangential rope sheave, i.e. as a vibration damper.

FIGS. 4 and 5 illustrate the method of the invention for making an elevator. In the method, the same machine and the same traction and rope sheaves can be used with both heavy and light elevator cars by changing the roping. Angle of the rope sheave can be changed to cause the ropes to run advantageously crosswise.

FIG. 6 presents an embodiment of the invention wherein the elevator drive machine 601 is fitted together with a rope sheave 602 on the same mounting base 603 in a ready-made unit 604, which can be fitted as such to form a part of an elevator according to the invention. The unit 604 contains the elevator drive machine 601, the traction sheave 605 and the rope sheave 602 ready-fitted on the mounting base 603, the traction sheave and rope sheave being ready fitted at a correct operating angle relative to each other, depending on the roping arrangement used between the traction sheave 605 and the rope sheave 602. The unit 604 may comprise more than only one rope sheave 602, or it may only comprise the drive machine 601 fitted on the mounting base 603. The unit can be mounted in an elevator according to the invention like a drive machine, the mounting arrangement being described in greater detail in connection with the previous figures. If necessary, the unit can be used together with both Double Wrap and Single Wrap roping arrangements. By fitting the above-described unit as a part of an elevator according to the invention, considerable savings can be achieved in installation costs and in the time required for installation.

An advantageous solution is to build a complete unit comprising a mounting base carrying both a pre-fitted elevator drive machine with a traction sheave and a rope sheave for increasing the angle of contact and its bearings, fitted in a correct operating angle relative to the traction sheave. The mounting base defines the mutual position and/or distance between the traction sheave and the rope sheave. This unit can be mounted in place as a unitary aggregate in the same way as a drive machine. The drive machine may be fixed to a wall of the elevator shaft, to the ceiling, to a guide rail or guide rails or to some other structure, such as a beam or frame. In the case of an elevator with machine below, a further possibility is to mount the machine on the bottom of the elevator shaft.

It is obvious to the person skilled in the art that different embodiments of the invention are not limited to the examples described above, but that they may be varied within the scope of the following claims. For instance, the number of times the hoisting ropes are passed between the upper part of the elevator shaft and the counterweight or elevator car is not a very decisive question as regards the basic advantages of the invention, although it is possible to achieve some additional advantages by using multiple rope passages. In general, embodiments should be so implemented that the ropes go to the elevator car at most as many times as to the counterweight. It is also obvious that the hoisting ropes need not necessarily be passed under the car; instead, they may also be passed over or sideways past the elevator car.

In accordance with the examples described above, the skilled person can vary the embodiment of the invention, while the traction sheaves and rope sheaves, instead of being coated metal sheaves, may also be uncoated metal sheaves or uncoated sheaves made of some other material suited to the purpose. It is also obvious that the metallic traction sheaves and rope sheaves used in the invention, which are coated with a non-metallic material at least in the area of their grooves, may be implemented using a coating material consisting of e.g. rubber, polyurethane or some other material suited to the purpose.

It is also obvious to the skilled person that the design of the bearings may vary depending on the load and the intended use. It is also obvious that, instead of using ropes with a filler, the roping arrangement of the invention may be implemented using ropes without filler, either lubricated or unlubricated. The ropes may be twisted in many different ways, and they may be thin or thick or of some other size and they may be of a substantially round or some other shape in cross-section.

It is also obvious to the person skilled in the art that the elevator car, the counterweight and the machine unit maybe laid out in the cross-section of the elevator shaft in a manner differing from the lay-out described in the examples. Such a different lay-out might be e.g. one in which the machine and the counterweight are located behind the car as seen from the shaft door and the ropes are passed under the car diagonally relative to the bottom of the car. Passing the ropes under the car in a diagonal or otherwise oblique direction relative to the form of the bottom provides an advantage when the suspension of the car on the ropes is to be made symmetrical relative to the center of mass of the elevator in other types of suspension lay-out as well.

The invention claimed is:

1. A method for delivering an elevator, the elevator including at least an elevator car, a counterweight, hoisting ropes, a drive machine, a traction sheave, and a rope sheave, the method comprising:

selecting a roping arrangement according to a weight of the elevator car, independent of the drive machine, the traction sheave, and the rope sheave;

wherein if the weight of the elevator car does not require the use of a double-wrap roping arrangement, then a single-wrap roping arrangement is used so that the hoisting ropes are passed around the traction sheave and the rope sheave to guide the hoisting ropes and dampen vibrations, and wherein if the weight of the elevator car requires the use of the double-wrap roping arrangement, then the double-wrap roping arrangement is used so that the hoisting ropes are passed at least twice around the traction sheave and at least once around the rope sheave to guide the hoisting ropes and dampen vibrations.

2. The method of claim 1, wherein the rope sheave is arranged to function as a dampening wheel for the hoisting ropes.

3. The method of claim 1, wherein an angle of contact of at least 180 degrees between the traction sheave and the hoisting ropes is achieved.

4. The method of claim 1, wherein the hoisting ropes have a substantially round cross-section.

5. The method of claim 1, wherein the elevator car and the counterweight are suspended with a suspension ratio of 1:1, 2:1, 3:1, 4:1 or greater.

6. The method of claim 1, wherein the drive machine is a geared-type drive machine or a gearless-type drive machine.

7. The method of claim 1, wherein the elevator is arranged to operate so that a mounting base, on which the drive machine, the traction sheave, and the rope sheave are mounted, controls a position of the rope sheave and the traction sheave relative to each other and controls the distance between the rope sheave and the traction sheave.

8. The method of claim 7, wherein at least the drive machine, the traction sheave, and the mounting base are fitted as a complete unit.

9. A system for a delivery of an elevator, comprising:

an elevator car;

a counterweight;

hoisting ropes;

a drive machine;

a traction sheave driven by the drive machine; and a rope sheave;

wherein the elevator car and the counterweight are to be suspended on the hoisting ropes, wherein if a weight of the elevator car does not require the use of a double-wrap roping arrangement, then the hoisting ropes are implemented as a single-wrap roping arrangement by passing around the traction sheave and the rope sheave to guide the hoisting ropes and dampen vibrations, wherein if the weight of the elevator car requires the use of the double-wrap roping arrangement, then the hoisting ropes are implemented as the double-wrap roping arrangement by passing at least twice around the traction sheave and at least once around the rope sheave to guide the hoisting ropes and dampen vibrations, and wherein the implemented roping arrangement is independent of the drive machine, the traction sheave, and the rope sheave.

10. The system of claim 9, wherein the rope sheave is mounted in conjunction with or in a vicinity of the drive machine, and wherein the hoisting ropes are arranged to run in contact with the rope sheave adjacent to the elevator car.

11. The method of claim 1, wherein the elevator car or the counterweight is suspended with a suspension ratio of 1:1, 2:1, 3:1, 4:1, or greater.

12. The method of claim 1, wherein the elevator is arranged to operate so that a mounting base, on which the drive machine, the traction sheave, and the rope sheave are mounted, controls a position of the rope sheave and the traction sheave relative to each other or controls the distance between the rope sheave and the traction sheave.

13. The method of claim 1, wherein the elevator is delivered without a machine room.

14. The system of claim 9, wherein the elevator is delivered without a machine room.

* * * * *